US010233610B1

(12) United States Patent
Nightingale

(10) Patent No.: US 10,233,610 B1
(45) Date of Patent: Mar. 19, 2019

(54) PIER AND BEAM FOUNDATION LEVELING SYSTEM

(71) Applicant: John Nightingale, Stella, NC (US)

(72) Inventor: John Nightingale, Stella, NC (US)

( * ) Notice: Subject to any disclaimer, the term of this patent is extended or adjusted under 35 U.S.C. 154(b) by 0 days.

(21) Appl. No.: 15/825,052

(22) Filed: Nov. 28, 2017

(51) Int. Cl.

| | |
|---|---|
| ***E02D 35/00*** | (2006.01) |
| ***E04G 23/06*** | (2006.01) |
| ***E02D 27/48*** | (2006.01) |
| ***E04B 1/343*** | (2006.01) |
| ***E04G 21/18*** | (2006.01) |

(52) U.S. Cl.
CPC ..... *E02D 35/005* (2013.01); *E02D 27/48* (2013.01); *E04B 1/34352* (2013.01); *E04G 21/18* (2013.01); *E04G 23/065* (2013.01)

(58) Field of Classification Search
CPC . E04B 1/34352; E04G 23/065; E04G 21/163; E02D 27/48; E02D 35/005
USPC ..... 52/126.5, 126.6
See application file for complete search history.

(56) References Cited

U.S. PATENT DOCUMENTS 2,115,824 A * 5/1938 McRorey ..... E04H 9/021 254/98
2,280,220 A * 4/1942 Crosby ..... E04B 1/36 52/126.6
2,380,692 A * 7/1945 Gunnison ..... E04B 1/36 254/98
4,348,841 A * 9/1982 Ueno ..... E04D 3/351 52/126.5
4,593,499 A * 6/1986 Kobayashi ..... E04F 15/0247 52/126.6
5,623,792 A * 4/1997 Crumpacker ..... E02D 27/32 52/103
7,823,341 B2 * 11/2010 Kelly ..... E02D 27/34 52/126.5
8,186,115 B2 * 5/2012 Harig ..... E02D 27/00 52/106
8,235,346 B2 * 8/2012 Bakos ..... E04H 12/2261 248/354.1
8,568,055 B2 * 10/2013 Marques Lito Velez Grilo ..... E02D 27/42 248/900
2002/0170244 A1 * 11/2002 Kim ..... E04B 1/161 52/126.5
2006/0216117 A1 * 9/2006 Peterson ..... E02D 27/48 405/230
2008/0304919 A1 * 12/2008 Coyle ..... E02D 27/02 405/250

(Continued)

FOREIGN PATENT DOCUMENTS

FR 553567 A * 5/1923 ..... B66F 7/14

*Primary Examiner* — Christine T Cajilig

(57) ABSTRACT

A leveling apparatus many be used for building new construction or for releveling an existing structure. A user may place a leveling apparatus between a pier and a beam of a pier and beam foundation. The leveling apparatus may include a bottom plate that rests on the pier and a top plate that supports the beam. The bottom plate and the top plate may be separated by threaded rods. The leveling apparatus may be sufficiently small that it may fit between the pier and beam in situations where space may be limited. The user may rotate one or more nut fasteners to adjust the height between the bottom plate and the top plate. Adjusting the separation between the plates can result in leveling of a floor by adjusting the spacing between a beam and the ground.

20 Claims, 7 Drawing Sheets

100

(56) References Cited

U.S. PATENT DOCUMENTS

2010/0281790 A1* 11/2010 Burgess ..... E04F 15/0247
52/126.6
2012/0131862 A1* 5/2012 Hashimoto ..... E04F 15/02452
52/126.6
2012/0255242 A1* 10/2012 Patton ..... E01D 15/14
52/126.6

* cited by examiner

100

200

300

400

500

600

700

PIER AND BEAM FOUNDATION LEVELING SYSTEM

BACKGROUND

The following relates generally to leveling the floor of a structure, and more specifically to leveling the structure with a pier and beam foundation using a leveling apparatus between the piers and beams.

A pier and beam system may be used to provide a foundation for a structure such a home. A pier and beam foundation may include beams that rest on piers set into or onto the ground. The piers may include wood posts, concrete, or cinderblocks set deep into the ground to bear the weight of the building. A pier and beam foundation may not rest directly on the ground. That is, a crawl space may be created beneath the floor. This may provide access to utility lines (e.g., electrical and plumbing lines). In some cases, a pier and beam foundation may become uneven due to drying, shifting, and settling of construction materials. In other cases, a pier and beam foundation may become uneven due to unequal heights of piers caused by shifting and settling of the ground. Either scenario may result in tilting or sagging of the structure, stress on structural components, or even breaking of the foundation.

SUMMARY

The leveling apparatus many be used for building new construction or for releveling an existing structure. A user may place a leveling apparatus between a pier and a beam of a pier and beam foundation. The leveling apparatus may include a bottom plate that rests on the pier and a top plate that supports the beam. The bottom plate and the top plate may be separated by threaded rod. The user may rotate one or more nut fasteners to adjust the height between the bottom plate and the top plate. Adjusting the separation between the plates can result in leveling of a floor or adjusting the spacing between a beam and the ground.

In one embodiment, a leveling apparatus may include a bottom plate, one or more cylindrical rods fastened to the bottom plate, where each of the one or more rods comprises threading on at least a portion of an external surface, one or more nut fasteners, where each of the one or more nut fasteners comprises threading on an interior surface, and where the threading on the interior surface is in contact with the threading on the external surface of a cylindrical rod of the one or more cylindrical rods, and a top plate supported by the one or more nut fasteners.

In one embodiment, a leveling system may include a plurality of leveling apparatuses, each leveling apparatus configured to separate and transfer weight from a beam foundation of the structure to a pier of the structure, and each leveling apparatus comprising: a bottom plate; one or more cylindrical rods fastened to the bottom plate, where each of the one or more rods comprises threading on at least a portion of an external surface; one or more nut fasteners, where each of the one or more nut fasteners comprises threading on an interior surface, and where the threading on the interior surface is in contact with the threading on the external surface of a cylindrical rod of the one or more cylindrical rods; and a top plate supported by the one or more nut fasteners.

A method of providing a system for leveling the pier and beam foundation of a structure is described. The method may include providing a bottom plate, providing one or more cylindrical rods fastened to the bottom plate, where each of the one or more rods comprises threading on at least a portion of an external surface, providing one or more nut fasteners, where each of the one or more nut fasteners comprises threading on an interior surface, and where the threading on the interior surface is in contact with the threading on the external surface of a cylindrical rod of the one or more cylindrical rods, and providing a top plate supported by the one or more nut fasteners.

A method of leveling the pier and beam foundation of a structure is described. The method may include using a bottom plate to transfer a portion of the weight of the structure to a pier of the structure; using one or more cylindrical rods fastened to the bottom plate to transfer the portion of the weight of the structure to the bottom plate, where each of the one or more rods comprises threading on at least a portion of an external surface; using one or more nut fasteners to transfer the portion of the weight of the structure to the one or more cylindrical rods, where each of the one or more nut fasteners comprises threading on an interior surface, and where the threading on the interior surface is in contact with the threading on the external surface of a cylindrical rod of the one or more cylindrical rods; and using a top plate to transfer the portion of the weight of the structure from a beam to the one or more nut fasteners.

Some examples of the leveling apparatus described above may also include a pier in contact with the ground and the bottom plate. Some examples of the leveling apparatus described above may also include a beam at the base of a structure, where the beam may be situated on the top plate, where a portion of the weight of the structure may be distributed through the beam to the top plate, from the top plate to the one or more nut fasteners, from the one or more nut fasteners to the one or more cylindrical rods, from the one or more cylindrical rods to the bottom plate, from the bottom plate to the pier, and from the pier to the ground. Some examples of the leveling apparatus described above may also include one or more washers, where each of the one or more washers may be in contact with a nut fastener of the one or more nut fasteners and the top plate to transfer and distribute force between the nut fastener and the top plate.

In some examples of the leveling apparatus described above, each of the one or more cylindrical rods may be fastened to the bottom plate through a hole in the bottom plate, where each of the one or more cylindrical rods extends at least partially into the bottom plate. In some examples, each of the one or more cylindrical rods may be fastened to the bottom plate via welding. In some examples of the leveling apparatus described above, the top plate comprises one or more circular holes, where each of the one or more cylindrical rods passes through the top plate via a circular hole of the one or more circular holes. In some examples, the one or more cylindrical rods may be each located a same distance from an external edge of the bottom plate.

In some examples of the leveling apparatus described above, the one or more cylindrical rods comprise two cylindrical rods aligned with a central axis of the bottom plate, where the central axis comprises a line in a horizontal plane of the bottom plate that may be perpendicular to two edges of the bottom plate and passes through a center point of each of the two edges of the bottom plate. In some examples of the leveling apparatus described above, the one or more cylindrical rods may be separated by a distance of between 4 inches and 18 inches.

In some examples of the leveling apparatus described above, the one or more cylindrical rods comprise four cylindrical rods arranged according to a rectangular pattern, where each of cylindrical rod of the one or more cylindrical rods may be located at a corner of the rectangular pattern. In some examples, the rectangular pattern may have a length between 4 inches and 12 inches and a width between 4 inches and 12 inches. In some examples of the leveling apparatus described above, the top plate, the bottom plate or both comprise a rectangular prism. In some examples, the top plate, the bottom plate or both comprise a cylinder in which a height of the cylinder may be less than a radius of the cylinder.

In some examples of the leveling apparatus described above, the top plate, the bottom plate, or both may have a thickness of between ¼ inch and one inch. In some examples, the top plate, the bottom plate, or both may have a length between 6 inches and 24 inches and a width between 6 inches and 24 inches. In some examples of the leveling apparatus described above, the top plate and the bottom plate may have a same size and a same shape. In some examples, the top plate, the bottom plate, or both comprise a steel plate or a metal alloy plate other than steel. In some examples, each of the one or more cylindrical rods may have a diameter between ½ inch and 2 inches, and a length between 2 inches and 24 inches.

DETAILED DESCRIPTION

Figure 1:
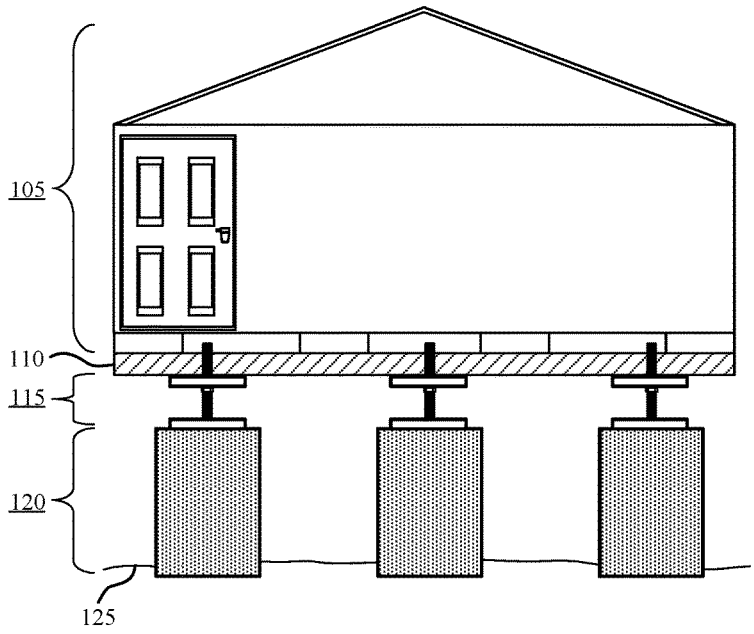
FIG. 1 shows a diagram of a support system that supports leveling the structure with a pier and beam foundation using a leveling apparatus between the piers and beams in accordance with aspects of the present disclosure.

FIG. 1 shows a diagram 100 of a support system that supports leveling the structure 105 with a pier and beam foundation using a leveling apparatus 115 between the piers 120 and beams 110 in accordance with aspects of the present disclosure. Diagram 100 may include structure 105, beam 110, leveling apparatus 115, pier 120, and ground 125. Leveling apparatus 115 may incorporate aspects of leveling apparatus 205 as described with reference to FIG. 2.

Structure 105 may represent a house, a commercial building, or any structure that is supported by a pier and beam foundation. Beam 110, may be a part of the bottom of the structure 105 or may be at the base of, but separate from the structure 105. A beam 110 may support a portion of the weight of the structure 105 and may transfer that weight onto the leveling apparatus 115. A beam 110 may be formed from wood, metal, or another suitable structural material.

Beam 110 is situated on the top plate, and a portion of the weight of the structure 105 is distributed through the beam 110 to the top plate, from the top plate to the one or more nut fasteners, from the one or more nut fasteners to the one or more cylindrical rods, from the one or more cylindrical rods to the bottom plate, from the bottom plate to the pier 120, and from the pier 120 to the ground 125.

Leveling apparatus 115 may support the beam 110, and transfer weight from the beam to the pier 120. The leveling apparatus 115 may be adjustable in height so that if the beams 110 of a foundation are uneven or not equal heights due to drying, shifting, and settling of construction materials the beams 110 may remain level. In some cases, the leveling apparatus may be sufficiently small that it may fit between the pier and beam in situations where space may be limited.

Pier 120 may support the leveling apparatus 115, and transmit weight from the leveling apparatus 115 into the ground 125. The pier 120 may be wood, concrete, cinderblock, metal, or any other suitable structural material. The pier 120 extends into the ground 125 for additional stability. In some cases, the piers 120 of a foundation are of equal height, but in other cases the leveling apparatus 115 may be adjustable when the piers 120 of a foundation have variable or unequal heights caused by shifting and settling of the ground 125. In some examples, the leveling apparatus 115 may be fastened to the pier 120. In other cases, the leveling apparatus 115 may sit freely on the pier 120.

Ground 125 may support the weight of the structure 105 via the pier and beam foundation (including the leveling apparatus 115). In some cases, the ground 125 beneath the structure 105 may be level, and in other cases the ground 125 may be unlevel. In some cases, the ground 125 is level initially but may become unlevel due to settling or shifting.

Figure 2:
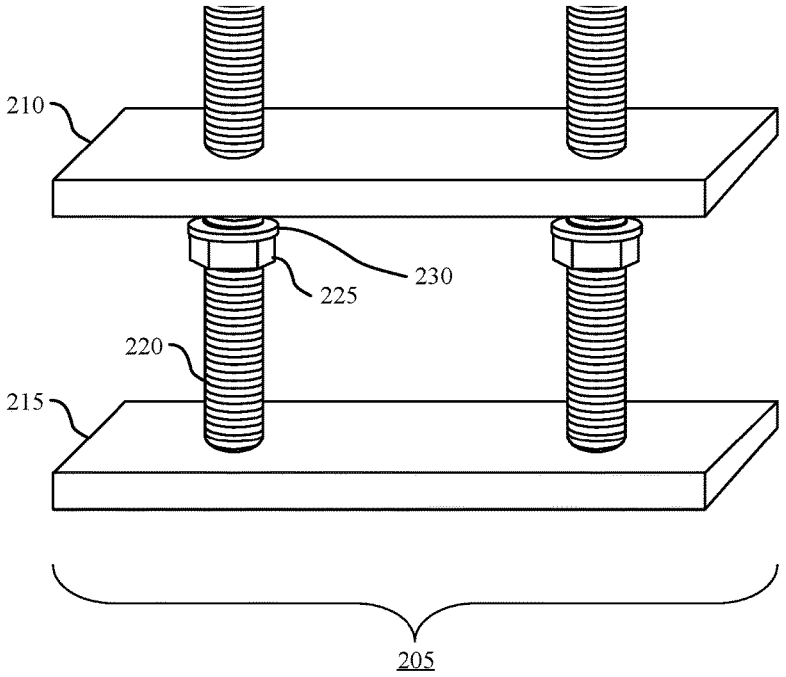
FIG. 2 shows a diagram of a leveling apparatus that supports leveling the structure with a pier and beam foundation using a leveling apparatus between the piers and beams in accordance with aspects of the present disclosure.

FIG. 2 shows a diagram 200 of a leveling apparatus 205 that supports leveling the structure with a pier and beam foundation using a leveling apparatus 205 between the piers and beams in accordance with aspects of the present disclosure. In some examples, leveling apparatus 205 may include top plate 210, bottom plate 215, cylindrical rod 220, nut fastener 225, and washer 230. Leveling apparatus 205 may incorporate aspects of leveling apparatus 115 as described with reference to FIG. 1.

Top plate 210 may be an example of a component supported by the one or more nut fasteners 225. Top plate 210 may support the weight of the beams and may transfer the weight through the washers 230 and nut fasteners 225 into the cylindrical rods 220. In some cases, the top plate 210 comprises one or more circular holes, where each of the one or more cylindrical rods 220 passes through the top plate 210 via a circular hole of the one or more circular holes. That is, the top plate 210 may have a number of holes through which the cylindrical rods 220 extend from below the plate to above it. The height of the top plate 210 (and thus, of the leveling apparatus 205) may be adjusted to level the pier and beam foundation of a structure.

Bottom plate 215 may be an example of a component of leveling apparatus 205. Bottom plate 215 may incorporate aspects of bottom plate 410 and 510 as described with reference to FIGS. 4 and 5. Cylindrical rod 220 may be an example of one or more components fastened to the bottom plate 215, where each of the one or more rods comprises threading on at least a portion of an external surface.

Bottom plate 215 may rest on a pier and transfer portion of the weight of the structure into the pier (and into the ground). The bottom plate 215 may have holes in which the cylindrical rods 220 are inserted to fasten the cylindrical rods 220 to the bottom plate 215. In one example, the top and bottom plate 215 are 1 inch thick rectangular steel plates.

In some cases, the top plate 210, the bottom plate 215 or both comprise a rectangular prism. In some cases, the top plate 210, the bottom plate 215 or both comprise a cylinder in which a height of the cylinder is less than a radius of the cylinder. In some cases, the top plate 210, the bottom plate 215, or both have a thickness of between ¼ inch and one inch. In some cases, the top plate 210, the bottom plate 215, or both have a length between 6 inches and 24 inches and a width between 6 inches and 24 inches. In some cases, the top plate 210 and the bottom plate 215 have a same size and a same shape. In some cases, the top plate 210, the bottom plate 215, or both comprise a steel plate or a metal alloy plate other than steel.

In some cases, each of the one or more cylindrical rods 220 is fastened to the bottom plate 215 through a hole in the bottom plate 215, where each of the one or more cylindrical rods 220 extends at least partially into the bottom plate 215. In some cases, each of the one or more cylindrical rods 220 is fastened to the bottom plate 215 via welding. In some cases, the one or more cylindrical rods 220 are each located a same distance from an external edge of the bottom plate 215. In some cases, the one or more cylindrical rods 220 comprise two cylindrical rods aligned with a central axis of the bottom plate 215, where the central axis comprises a line in a horizontal plane of the bottom plate 215 that is perpendicular to two edges of the bottom plate 215 and passes through a center point of each of the two edges of the bottom plate 215. In some cases, the one or more cylindrical rods 220 are separated by a distance of between 4 inches and 18 inches. In some cases, the one or more cylindrical rods 220 comprise four cylindrical rods 220 arranged according to a rectangular pattern, where each of cylindrical rod 220 of the one or more cylindrical rods 220 is located at a corner of the rectangular pattern. In some cases, each of the one or more cylindrical rods 220 has a diameter between ½ inch and 2 inches, and a length between 2 inches and 24 inches.

Cylindrical rods 220 may be connected to the bottom plate 215. For example, the cylindrical rods 220 may be at least partially inserted into and welded to the bottom plate 215. The cylindrical rods 220 support the weight of the structure and transfer the supported weight from the top plate 210 (via the nut fasteners 225) to the bottom plate 215. The cylindrical rods 220 may be partially threaded to support connection to (and adjustment of) the nut fasteners 225. In one example, the cylindrical rods 220 may be 1 inch thick steel rods. In some examples, the rods 220 may be a shape other than a cylinder, such as a rectangular prism or as a bar having some other polygonal cross-section. In this embodiment, the nut fastener may be adjusted using a ratcheting operation rather than a rotation.

Nut fastener 225 may be an example of one or more components, where each of the one or more nut fasteners 225 comprises threading on an interior surface, and where the threading on the interior surface is in contact with the threading on the external surface of a cylindrical rod 220 of the one or more cylindrical rods 220. Nut fasteners 225 may be threaded around the cylindrical rods 220. The nut fasteners 225 may be rotated to adjust the height of the top plate 210 (and thus, the leveling apparatus 205).

Washer 230 may be an example of one or more components, where each of the one or more washers 230 is in contact with a nut fastener 225 of the one or more nut fasteners 225 and the top plate 210 to transfer and distribute force between the nut fastener 225 and the top plate 210. In some embodiments, washers 230 may be placed between the nut fasteners 225 and the top plate 210 to distribute weight onto the nut fasteners 225 and to facilitate easier adjustment of the nut fasteners 225.

Figure 3:
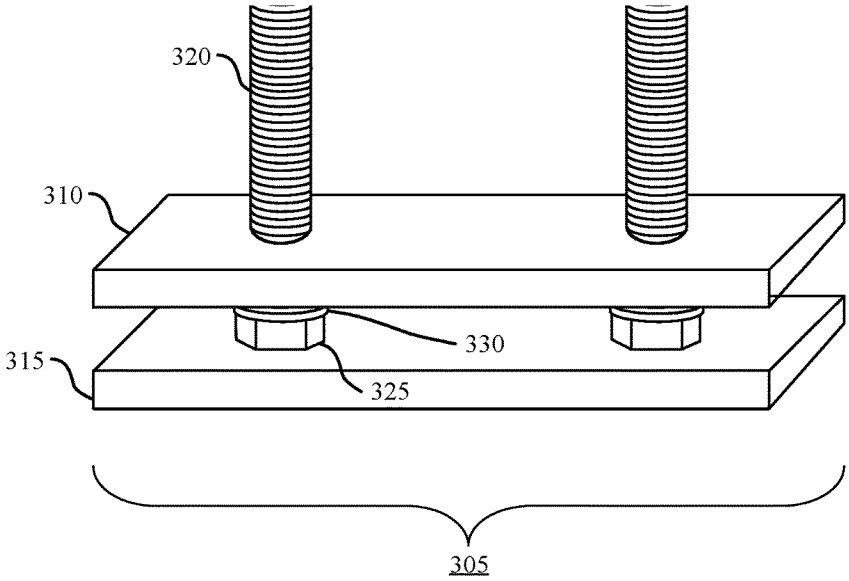
FIG. 3 shows a diagram of a leveling apparatus that has been adjusted to reduce the separation between the top plate and the bottom plate, that supports leveling the structure with a pier and beam foundation using a leveling apparatus between the piers and beams in accordance with aspects of the present disclosure.

FIG. 3 shows a diagram 300 of a leveling apparatus 305 that supports leveling the structure with a pier and beam foundation using a leveling apparatus 305 between the piers and beams in accordance with aspects of the present disclosure. Diagram 300 illustrates an example in which the leveling apparatus 305 has been adjusted to reduce the separation between the top plate 310 and the bottom plate 315. Reducing the separation between the top plate 310 and the bottom plate 315 may allow the leveling apparatus to fit in a smaller available space between the pier and the beam. In some examples, leveling apparatus 305 may include top plate 310, bottom plate 315, cylindrical rod 320, nut fastener 325, and washer 330. Leveling apparatus 305 may incorporate aspects of leveling apparatus 115 and 205 as described with reference to FIG. 1 and FIG. 2.

Figure 4:
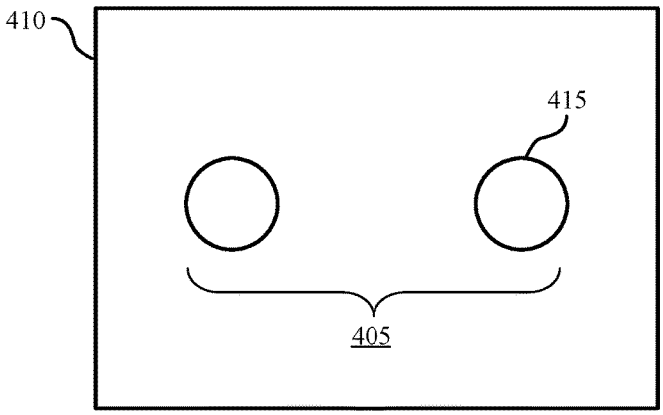
FIG. 4 shows a diagram of a linear pattern that supports leveling the structure with a pier and beam foundation using a leveling apparatus between the piers and beams in accordance with aspects of the present disclosure.

FIG. 4 shows a diagram 400 of a linear pattern 405 that supports leveling the structure with a pier and beam foundation using a leveling apparatus between the piers and beams in accordance with aspects of the present disclosure. Diagram 400 may include linear pattern 405, bottom plate 410, and end point 415.

Bottom plate 410 may be an example of a component of leveling apparatus. Bottom plate 410 may incorporate aspects of bottom plate 215 and 510 as described with reference to FIGS. 2 and 5. End point 415 may incorporate aspects of end point 515 as described with reference to FIG. 5.

In one embodiment, bottom plate 410 may be connected to two cylindrical rods according to a linear pattern. A top plate may have holes arranged in the same linear pattern 405. Cylindrical rods may be arranged according to the linear pattern 405 and extend from the bottom plate 410 through the top plate. The linear pattern 405 may include two end points 415 that represent the placement of the cylindrical rods on the bottom plate 410. In one example, the linear pattern 405 may have a width of 6 inches or more.

Figure 5:
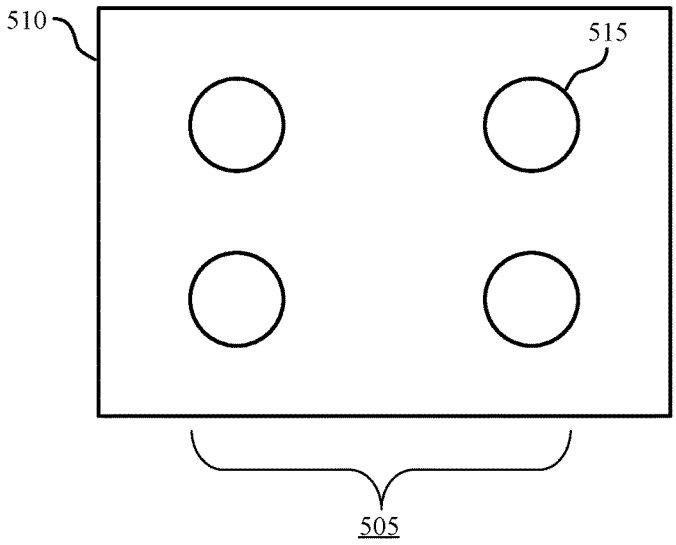
FIG. 5 shows a diagram of a rectangular pattern that supports leveling the structure with a pier and beam foundation using a leveling apparatus between the piers and beams in accordance with aspects of the present disclosure.

FIG. 5 shows a diagram 500 of a rectangular pattern 505 that supports leveling the structure with a pier and beam foundation using a leveling apparatus between the piers and beams in accordance with aspects of the present disclosure. Diagram 500 may include rectangular pattern 505, bottom plate 510, and end point 515.

Bottom plate 510 may be an example of a component of leveling apparatus. Bottom plate 510 may incorporate aspects of bottom plate 215 and 410 as described with reference to FIGS. 2 and 4. End point 515 may incorporate aspects of end point 415 as described with reference to FIG. 4.

In one embodiment, bottom plate 510 may be connected to four cylindrical rods according to a rectangular pattern 505. A top plate may have holes arranged in the same rectangular pattern 505. Cylindrical rods may be arranged according to the rectangular pattern 505 and extend from the bottom plate 510 through the top plate.

The rectangular pattern 505 may include four end points 515 that represent the placement of the cylindrical rods on the bottom plate 510. In one example, the rectangular pattern 505 may have a length of 8 inches and a width of 6 inches.

In some cases, the rectangular pattern 505 has a length between 4 inches and 12 inches and a width between 4 inches and 12 inches.

Figure 6:
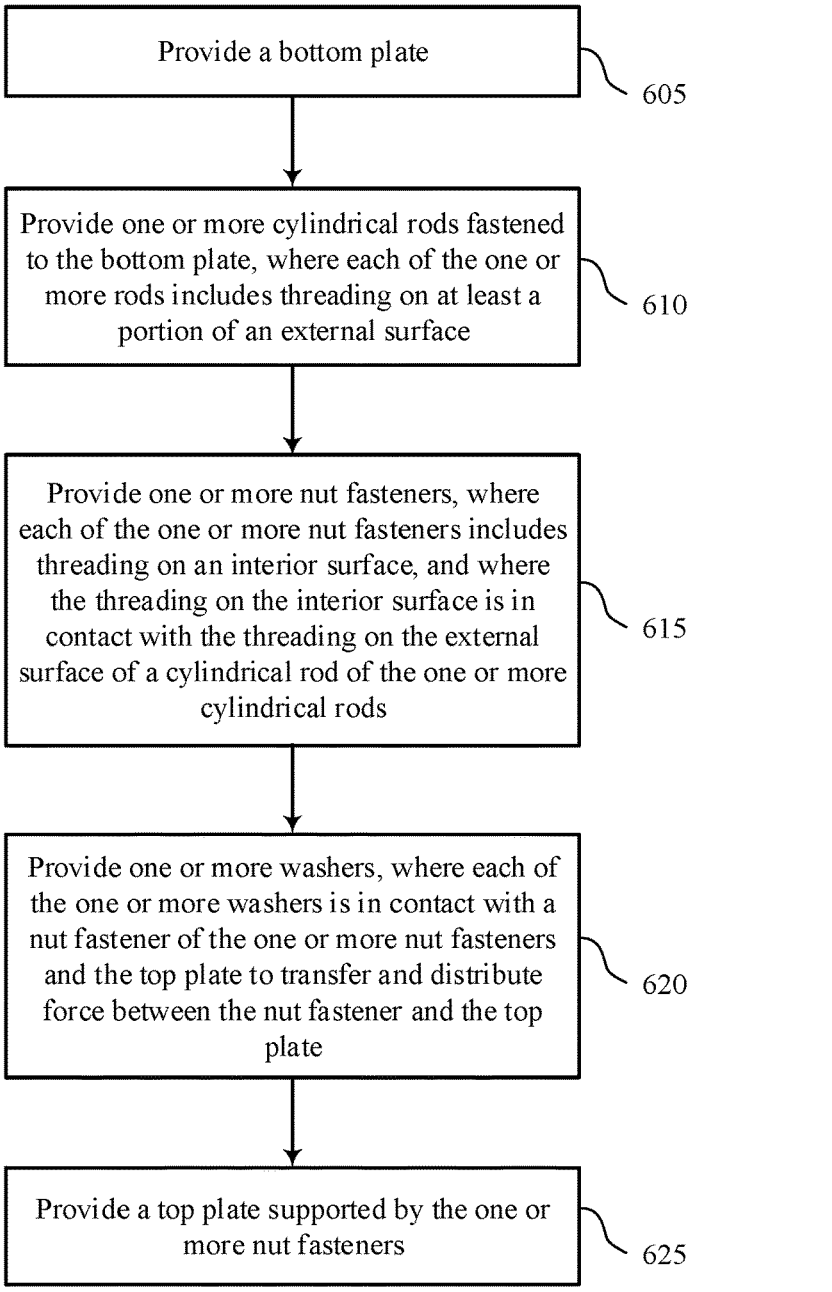
FIGS. 6 and 7 show flowcharts of processes for leveling the structure with a pier and beam foundation using a leveling apparatus between the piers and beams in accordance with aspects of the present disclosure.

FIG. 6 shows a flowchart 600 of a process performed by a user or manufacturer for making a leveling apparatus and for leveling a structure with a pier and beam foundation using a leveling apparatus between the piers and beams in accordance with aspects of the present disclosure. In some examples, a manufacturer or user may execute a set of codes to control functional elements of the support system to perform the described functions. Additionally or alternatively, a user or manufacturer may use special-purpose hardware.

At block 605 the manufacturer may provide a bottom plate. These operations may be performed according to the methods and processes described in accordance with aspects of the present disclosure. For example, the operations may be composed of various substeps, or may be performed in conjunction with other operations described herein.

At block 610 the manufacturer may provide one or more cylindrical rods fastened to the bottom plate, where each of the one or more rods comprises threading on at least a portion of an external surface. These operations may be performed according to the methods and processes described in accordance with aspects of the present disclosure. For example, the operations may be composed of various substeps, or may be performed in conjunction with other operations described herein.

At block 615 the manufacturer may provide one or more nut fasteners, where each of the one or more nut fasteners comprises threading on an interior surface, and where the threading on the interior surface is in contact with the threading on the external surface of a cylindrical rod of the one or more cylindrical rods. These operations may be performed according to the methods and processes described in accordance with aspects of the present disclosure. For example, the operations may be composed of various substeps, or may be performed in conjunction with other operations described herein.

At block 620 the manufacturer may provide one or more washers, where each of the one or more washers is in contact with a nut fastener of the one or more nut fasteners and the top plate to transfer and distribute force between the nut fastener and the top plate. These operations may be performed according to the methods and processes described in accordance with aspects of the present disclosure. For example, the operations may be composed of various substeps, or may be performed in conjunction with other operations described herein.

At block 625 the manufacturer may provide a top plate supported by the one or more nut fasteners. These operations may be performed according to the methods and processes described in accordance with aspects of the present disclosure. For example, the operations may be composed of various substeps, or may be performed in conjunction with other operations described herein.

Figure 7:
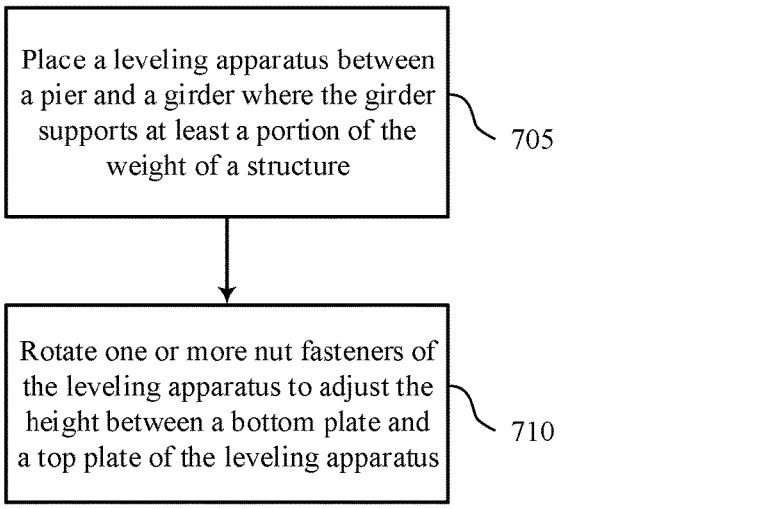

FIG. 7 shows a flowchart 700 of a process performed by a user for leveling the structure with a pier and beam foundation using a leveling apparatus between the piers and beams in accordance with aspects of the present disclosure.

At block 705 the user may place the leveling apparatus between a pier and a beam where the beam supports at least a portion of the weight of a structure. These operations may be performed according to the methods and processes described in accordance with aspects of the present disclosure. For example, the operations may be composed of various substeps, or may be performed in conjunction with other operations described herein.

At block 710 the user may rotate one or more nut fasteners of the leveling apparatus to adjust the height between the bottom plate and the top plate. These operations may be performed according to the methods and processes described in accordance with aspects of the present disclosure. For example, the operations may be composed of various substeps, or may be performed in conjunction with other operations described herein.

The description and drawings described herein represent example configurations and do not represent all the implementations within the scope of the claims. For example, the operations and steps may be rearranged, combined or otherwise modified. Also, structures and devices may be represented in the form of block diagrams to represent the relationship between components and avoid obscuring the described concepts. Similar components or features may have the same name but may have different reference numbers corresponding to different figures.

Some modifications to the disclosure may be readily apparent to those skilled in the art, and the principles defined herein may be applied to other variations without departing from the scope of the disclosure. Thus, the disclosure is not limited to the examples and designs described herein, but is to be accorded the broadest scope consistent with the principles and novel features disclosed herein.

In this disclosure and the following claims, the word "or" indicates an inclusive list such that, for example, the list of X, Y, or Z means X or Y or Z or XY or XZ or YZ or XYZ. Also the phrase "based on" is not used to represent a closed set of conditions. For example, a step that is described as "based on condition A" may be based on both condition A and condition B. In other words, the phrase "based on" shall be construed to mean "based at least in part on."

What is claimed is:

1. An apparatus for leveling the pier and beam foundation of a structure, comprising:

a bottom plate;

two or more cylindrical rods fastened to the bottom plate, wherein each of the two or more rods comprises threading on at least a portion of an external surface and each of the two or more cylindrical rods extends no further than a bottom surface of the bottom plate;

two or more nut fasteners, wherein each of the two or more nut fasteners comprises threading on an interior surface, and wherein the threading on the interior surface is in contact with the threading on the external surface of a cylindrical rod of the two or more cylindrical rods; and a top plate supported by the two or more nut fasteners, wherein the two or more cylindrical rods pass through the top plate on two opposite sides of the top plate, such that a central portion of the top plate is open across a width of the top plate and a beam of the pier and beam foundation may extend across the width of the top plate between the two or more cylindrical rods.

2. The apparatus of claim 1, further comprising:

a pier in contact with the ground and the bottom plate; and a beam at the base of a structure, wherein the beam is situated on the top plate, wherein a portion of the weight of the structure is distributed through the beam to the top plate, from the top plate to the two or more nut fasteners, from the two or more nut fasteners to the two or more cylindrical rods, from the two or more cylindrical rods to the bottom plate, from the bottom plate to the pier, and from the pier to the ground.

3. The apparatus of claim 1, further comprising:
two or more washers, wherein each of the two or more washers is in contact with a nut fastener of the two or more nut fasteners and the top plate to transfer and distribute force between the nut fastener and the top plate.

4. The apparatus of claim 1, wherein: each of the two or more cylindrical rods is fastened to the bottom plate through a hole in the bottom plate, wherein each of the two or more cylindrical rods extends at least partially into the bottom plate.

5. The apparatus of claim 1, wherein:
each of the two or more cylindrical rods is fastened to the bottom plate via welding.

6. The apparatus of claim 1, wherein:
the top plate comprises two or more circular holes, wherein each of the two or more cylindrical rods passes through the top plate via a circular hole of the two or more circular holes.

7. The apparatus of claim 1, wherein:
the two or more cylindrical rods are each located a same distance from an external edge of the bottom plate.

8. The apparatus of claim 1, wherein:
the two or more cylindrical rods comprise two cylindrical rods aligned with a central axis of the bottom plate, wherein the central axis comprises a line in a horizontal plane of the bottom plate that is perpendicular to two edges of the bottom plate and passes through a center point of each of the two edges of the bottom plate.

9. The apparatus of claim 8, wherein:
the two or more cylindrical rods are separated by a distance of between 4 inches and 18 inches.

10. The apparatus of claim 1, wherein:
the two or more cylindrical rods comprise four cylindrical rods arranged according to a rectangular pattern, wherein each of cylindrical rod of the two or more cylindrical rods is located at a corner of the rectangular pattern.

11. The apparatus of claim 10, wherein:
the rectangular pattern has a length between 4 inches and 12 inches and a width between 4 inches and 12 inches.

12. The apparatus of claim 10, wherein:
the top plate, the bottom plate or both comprise a rectangular prism.

13. The apparatus of claim 1, wherein:
the top plate, the bottom plate, or both have a thickness of between ¼ inch and one inch; and
the top plate, the bottom plate, or both have a length between 6 inches and 24 inches and a width between 6 inches and 24 inches.

14. The apparatus of claim 1, wherein:
the top plate and the bottom plate have a same size and a same shape.

15. The apparatus of claim 1, wherein:
the top plate, the bottom plate, or both comprise a steel plate or a metal alloy plate other than steel.

16. The apparatus of claim 1, wherein:
each of the two or more cylindrical rods has a diameter between ½ inch and 2 inches, and a length between 2 inches and 24 inches.

17. The apparatus of claim 1, further comprising:
a ratcheting component, operable to adjust the position of the nut fastener.

18. A system for leveling the pier and beam foundation of a structure, comprising:
a plurality of leveling apparatuses, each leveling apparatus configured to separate and transfer weight from a beam of the structure to a pier of the structure, and each leveling apparatus comprising:
a bottom plate;
two or more cylindrical rods fastened to the bottom plate, wherein each of the two or more rods comprises threading on at least a portion of an external surface and each of the two or more cylindrical rods extends no further than a bottom surface of the bottom plate;
two or more nut fasteners, wherein each of the two or more nut fasteners comprises threading on an interior surface, and wherein the threading on the interior surface is in contact with the threading on the external surface of a cylindrical rod of the two or more cylindrical rods; and
a top plate supported by the two or more nut fasteners, wherein the two or more cylindrical rods pass through the top plate on two opposite sides of the top plate, such that a central portion of the top plate is open across a width of the top plate and a beam of the pier and beam foundation may extend across the width of the top plate between the two or more cylindrical rods.

19. A method for leveling the pier and beam foundation of a structure, comprising:
using a bottom plate to transfer a portion of the weight of the structure to a pier of the structure;
using two or more cylindrical rods fastened to the bottom plate to transfer the portion of the weight of the structure to the bottom plate, wherein each of the two or more rods comprises threading on at least a portion of an external surface and each of the two or more cylindrical rods extends no further than a bottom surface of the bottom plate;
using two or more nut fasteners to transfer the portion of the weight of the structure to the two or more cylindrical rods, wherein each of the two or more nut fasteners comprises threading on an interior surface, and wherein the threading on the interior surface is in contact with the threading on the external surface of a cylindrical rod of the two or more cylindrical rods; and
using a top plate to transfer the portion of the weight of the structure from a beam to the two or more nut fasteners, wherein the two or more cylindrical rods pass through the top plate on two opposite sides of the top plate, such that a central portion of the top plate is open across a width of the top plate and the beam may extend across the width of the top plate between the two or more cylindrical rods.

20. The method of claim 19, further comprising:
rotating at least one of the two or more nut fasteners to adjust a distance between the bottom plate and the top plate.

* * * * *